United States Patent [19]

Harder

[11] Patent Number: 4,684,604

[45] Date of Patent: Aug. 4, 1987

[54] OXIDATIVE RELEASE OF PHOTOGRAPHICALLY USEFUL GROUPS FROM HYDRAZIDE COMPOUNDS

[75] Inventor: John W. Harder, Rochester, N.Y.

[73] Assignee: Eastman Kodak Company, Rochester, N.Y.

[21] Appl. No.: 855,264

[22] Filed: Apr. 24, 1986

[51] Int. Cl.[4] ..... G03C 1/40; G03C 1/34; G03C 7/32; G03C 5/54

[52] U.S. Cl. ..... 430/375; 430/223; 430/375; 430/434; 430/435; 430/440; 430/443; 430/445; 430/446; 430/505; 430/542; 430/543; 430/544; 430/558; 430/559; 430/564; 430/566; 430/570; 430/598; 430/599; 430/600; 430/607; 430/611; 430/613; 430/621; 430/623; 430/955; 430/957; 430/959

[58] Field of Search ..... 430/223, 955, 957, 959, 430/958, 375, 376, 434, 435, 440, 443, 445, 446, 505, 542, 543, 544, 558, 559, 564, 566, 570, 598, 599, 600, 607, 611, 613, 621, 623

[56] References Cited

U.S. PATENT DOCUMENTS

| | | | |
|---|---|---|---|
| 3,227,552 | 1/1966 | Whitmore | 430/239 |
| 3,245,789 | 4/1966 | Rogers | 430/223 |
| 3,249,431 | 5/1966 | Jaeken et al. | 430/361 |
| 3,628,952 | 12/1971 | Puschel et al. | 430/223 |
| 3,782,949 | 1/1974 | Olivares et al. | 96/76 R |
| 3,844,785 | 10/1974 | Puschel et al. | 430/223 |
| 4,030,925 | 6/1977 | Leone et al. | 430/217 |
| 4,207,392 | 6/1980 | Shiao et al. | 430/955 |
| 4,294,919 | 10/1981 | Tsujino et al. | 430/559 |
| 4,430,420 | 2/1984 | Adin | 430/619 |
| 4,619,884 | 10/1986 | Singer | 430/223 |

OTHER PUBLICATIONS

Research Disclosure No. 12832, Dec. 1974, p. 22, Lestina et al.

*Primary Examiner*—Richard L. Schilling
*Attorney, Agent, or Firm*—Harold E. Cole

[57] ABSTRACT

Photographic elements and processes are described which employ a compound containing a hydrazide moiety attached by a linking group, comprising an acidic group or an active methylene group adjacent to an acidic group, to a heteroatom of a moiety containing a photographically useful group comprising a photographic dye or precursor thereof or a photographic reagent; wherein:

(a) the hydrazide moiety is capable of being oxidized to an azo group by an oxidized developing agent, (b) the azo group formation causes the release of the photographically useful group, and (c) the released photographically useful group does not contain the linking group or the nitrogen atoms of the hydrazide moiety.

20 Claims, No Drawings

OXIDATIVE RELEASE OF PHOTOGRAPHICALLY USEFUL GROUPS FROM HYDRAZIDE COMPOUNDS

This invention relates to photographic compounds which release photographically useful groups during processing and to processes utilizing such compounds.

Images are commonly obtained in the photographic art by a coupling reaction between the development product of a silver halide color developing agent (i.e., oxidized aromatic primary amino developing agent) and a color forming compound commonly referred to as a coupler. The dyes produced by coupling are indoaniline, azomethine, indamine or indophenol dyes, depending upon the chemical composition of the coupler and the developing agent. The subtractive process of color formation is ordinarily employed in multicolor photographic elements and the resulting image dyes are usually cyan, magenta and yellow dyes which are formed in or adjacent to silver halide layers sensitive to radiation complementary to the radiation absorbed by the image dye; i.e., silver halide emulsions sensitive to red, green and blue radiation.

The patent and technical literature is replete with references to compounds which can be used as couplers for the formation of photographic images. preferred couplers which form cyan dyes upon reaction with oxidized color developing agents are phenols and naphthols. Representative couplers are described in the following patents and publications: U.S. Pat. Nos. 2,772,162, 2,895,826, 3,002,836, 3,034,892, 2,747,293, 2,423,730, 2,367,531, 3,041,236 and "Farbkuppler-eine Literaturubersicht," published in Agfa Mitteilungen, Band II, pp. 156–175 (1961).

preferred couplers which form magenta dyes upon reaction with oxidized color developing agent are pyrazolones, pyrazolotriazoles, pyrazolobenzimidazoles and indazolones. Representative couplers are described in such patents and publications as U.S. Pat. Nos. 2,600,788, 2,369,489, 2,343,703, 2,311,082, 2,673,801, 3,152,896, 3,519,429, 3,061,432, 3,062,653, 3,725,067, 2,908,573 and "Farbkuppler-eine Literaturubersicht," published in Agfa Mitteilungen, Band II, pp. 126–156 (1961).

Couplers which form yellow dyes upon reaction with oxidized color developing agent are acylacetanilides such as benzoylacetanilides and pivalylacetanilides. Representative couplers are described in the following patents and publications:

U.S. Pat. Nos. 2,875,057, 2,407,210, 3,265,506, 2,298,443, 3,048,194, 3,447,928 and "Farbkuppler-eine Literaturubersicht," published in Agfa Mitteilungen, Band II, pp. 112–126 (1961).

Compounds which release a photographically useful group (PUG) can also be employed in the coupling reaction. There are various ways in which a PUG can be released from a compound in a photographic element. For example, Whitmore et al U.S. Pat. No. 3,148,062 and Barr et al U.S. Pat. No. 3,227,554 show the release of a development inhibitor or a dye from the coupling position of a photographic coupler upon reaction of the coupler with oxidized color developing agent. The reaction of the coupler with oxidized color developing agent forms a dye, however. Three different development inhibitor-releasing (DIR) couplers are thus usually required in order to produce a three color element. It would be desirable to provide a compound which would release a PUG without forming a residual dye or other colored product, so that the same "universal" compound could be employed in each of the color forming units to produce the desired effect, thus eliminating the need for three different compounds.

U.S. Pat. No. 3,245,789 and Research Disclosure No. 12832, December 1974, p. 22 disclose hydrazide dye releasing compounds wherein part of an acidic group ($SO_2$— or CO—) linking the dye moiety to the rest of the compound is released along with the dye moiety. These groups, hydrolyzed to sulfo or carboxy forms, add to the solubility of the dye. In instances where a photographic reagent is desired to be released, however, such as a development inhibitor, such solubilizing groups would be detrimental since the reagent would not stay on the surface of the silver halide to perform its inhibiting function. It would be desirable to provide a compound wherein the linking group is not released as part of the released moiety, so that undesired effects can be avoided.

In U.S. Pat. Nos. 4,294,919, 3,227,552 and 4,030,925, hydrazide compounds containing an acyl moiety are disclosed as nucleating or fogging agents. In these compounds, however, the azo or diimide group which is formed is the "active" part of the compound, which is analogous to a released PUG. In the present invention, the released moiety does not contain the original hydrazide nitrogen atoms.

In U.S. Pat. No. 3,782,949, a hydrazide developing agent containing an acyl moiety is described. Here again, the azo or diimide group which is formed is the "active" part of the compound, which is analogous to a released PUG. The released moiety in the present invention does not contain the original hydrazide nitrogen atoms.

In U.S. Pat. No. 3,249,431, a hydrazide mask-forming compound is disclosed which oxidatively couples with a color developer to form a secondary dye image. However, there is no disclosure in this patent of any PUG being released by the coupling reaction.

U.S. Pat. No. 4,207,392 relates to an acylhydrazine activator-stabilizer compound having an acid portion and a base portion. The base portion containing a hydrazide moiety is released as a result of the compound being heated. In the present invention, the released moiety does not contain the hydrazide moiety.

According to the present invention a photographic element is provided which comprises a support having thereon a silver halide emulsion layer having associated therewith a compound containing a hydrazide moiety attached by a linking group, comprising an acidic group or an active methylene group adjacent to an acidic group, to a heteroatom of a moiety containing a PUG comprising a photographic dye or precursor thereof or a photographic reagent; wherein:

(a) the hydrazide moiety is capable of being oxidized to an azo group by an oxidized developing agent,
(b) the azo group formation causes the release of said PUG, and
(c) the released PUG does not contain the linking group or the nitrogen atoms of the hydrazide moiety.

In a preferred embodiment of the invention, the PUG is released by alkaline hydrolysis, beta-elimination or intramolecular nucleophilic displacement as in the following reaction sequences involving preferred compounds:

I.

$$RNHNH-V-Z \xrightarrow{Ag^+ \rightarrow Ag^o} RN=N-V-Z \xrightarrow{OH^-} RN=N-V-OH + Z^-$$

II.

$$RY-V_n-NHNHCH_2\underset{\underset{Z}{|}}{CH}-W \xrightarrow{Ag^+ \rightarrow Ag^o} RY-V_n-N=NCH_2\underset{\underset{Z}{|}}{CH}-W \xrightarrow{OH^-} RY-V_n-N=NCH=CH-W + Z^- + H_2O$$

III.

$$RY-V_n-NHN-\left(CH_2\underset{\underset{Z}{|}}{CH}-W\right)_2 \xrightarrow{Ag^+ \rightarrow Ag^o} RY-V_n-N=\overset{+}{N}-\left(CH_2\underset{\underset{Z}{|}}{CH}-W\right)_2 \xrightarrow{OH^-} RY-V_n-N=\overset{+}{N}(CH=CH-W)_2 + Z^- + H_2O$$

IV.

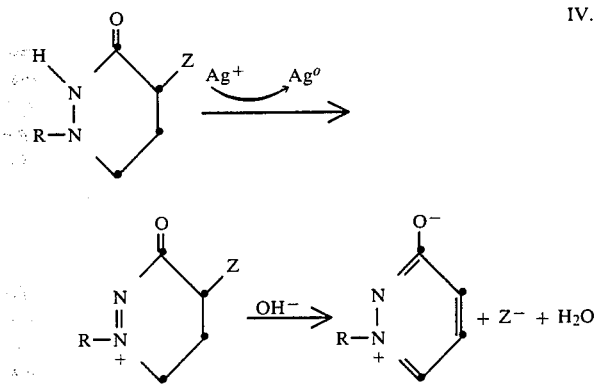

wherein:

R represents a substituted or unsubstituted alkyl group such as methyl, ethyl, dodecyl, benzyl, or methoxyethoxyethyl; a substituted or unsubstituted aryl group such as phenyl, naphthyl, p-octylphenyl, p-nitrophenyl, or m-pentadecylphenyl; or a substituted or unsubstituted heterocyclic group such as pyridyl, quinolyl, furyl, or 6-methyl- 2-pyridyl;

V represents an acidic group such as $$-SO-,\quad -SO_2-,\quad -\overset{\overset{X}{\|}}{C}-,\quad \text{or}\quad -\overset{\overset{O}{\|}}{P}(OR)-;$$

each W independently represents $-NO_2$, $-CN$, $-COOH$, $-SO_3H$, or $-V-YR$;

X represents O, S, or $NR_1$;

Y represents a bond or X;

each Z independently represents $-T_m-PUG$, having a heteroatom at its point of attachment;

T represents a divalent connecting group such as $-OCH_2-$ or other divalent timing groups such as those described in U.S. Pat. Nos. 4,248,962, 4,409,323, or 3,674,478, Research Disclosure No. 21228, December, 1981, or Japanese Patent Application No. J57/056,837, the disclosures of which are hereby incorporated by reference;

PUG represents a photographically useful group;

$R_1$ represents H or R; and n and m each independently represents 0 or 1.

A PUG which is released by the compounds of this invention can be any group which is made available in a photographic element in an imagewise fashion. PUGs are well known to those skilled in the art and include photographic dyes (or precursors thereof) or photographic reagents. A photographic reagent is a moiety which, upon release, undergoes a reaction with other compounds or components in the photographic element or composition used in processing. Useful photographic reagents include the following: a development inhibitor, a development accelerator, a bleach inhibitor, a bleach accelerator, a coupler, a developing agent, a silver complexing agent, a fixing agent, a toning agent, a hardening agent, a tanning agent, a fogging agent, an antifogging agent, a spectral sensitizing agent, a chemical sensitizing agent, and a desensitizing agent. Preferably, Z which contains PUG is attached 1 or 2 atoms removed from the hydrazide moiety.

In a preferred embodiment of the invention, the PUG is a development inhibitor. Development inhibitors released from compounds of the invention can provide desirable right-way interlayer interimage effects and sharpness in color reversal imaging, which are very difficult to attain by other means. A development inhibitor can also be released in accordance with the invention as a function of the black-and-white development step rather than the color development step. This can provide additional density in a "receiving" layer to provide color correction for unwanted dye absorptions in a "causer" layer, as will be shown in the examples hereinafter.

PUGs which form development inhibitors upon release are described, for example, in U.S. Pat. Nos. 3,227,554; 3,384,657; 3,615,506; 3,617,291; 3,733,201 and U.K. Patent No. 1,450,479. Preferred development inhibitors are iodide and heterocyclic compounds such as mercaptotetrazoles, selenotetrazoles, mercaptobenzothiazoles, selenobenzothiazoles, mercaptobenzoxazoles, selenobenzoxazoles, mercaptobenzimidazoles, selenobenzimidazoles, benzotriazoles and benzodiazoles.

PUGs which are, or form, dyes upon release include azo, azomethine, azopyrazolone, indoaniline, indophenol, anthraquinone, triarylmethane, alizarin, nitro, quinoline, indigoid and phthalocyanine dyes or precursors of such dyes such as leuco dyes, tetrazolium salts or shifted dyes. These dyes can be metal complexed or metal complexable. Representative patents describing such dyes are U.S. Pat. Nos. 3,880,658; 3,931,144; 3,932,380; 3,392,381; and 3,942,987. Preferred dyes and dye precursors are azo, azomethine and indoaniline dyes and dye precursors.

PUGs which are couplers upon release can be nondiffusible color-forming couplers, non-color forming couplers or diffusible competing couplers. Representative patents and publications describing competing couplers are: "On the Chemistry of White Couplers," by W. Püschel, Agfa-Gevaert AG Mitteilungen and der Forschungs-Laboratorium der Agfa-Gevaert AG, Springer Verlag, 1954, pp. 352-367; U.S. Pat. Nos. 2,998,314, 2,808,329, 2,689,793; 2,742,832; German Patent No. 1,168,769 and British Patent No. 907,274.

PUGs which form developing agents upon release can be color developing agents, black and white developing agents or cross-oxidizing developing agents. They include aminophenols, phenylene diamines, hydroquinones and pyrazolidones. Representative patents are: U.S. Pat. Nos. 2,193,015; 2,108,243; 2,592,364; 3,656,950; 3,658,525; 2,751,297; 2,289,367; 2,772,282; 2,743,279; 2,753,256; and 2,304,953.

PUGs which are bleach inhibitors are described, for example, in U.S. Pat. Nos. 3,705,801; 3,715,208; and German OLS No. 2,405,279.

The released PUGs of this invention can be employed in photographic elements in the ways and for the purposes which PUGs have previously been employed. For example, if the PUG is a development inhibitor, it can be used to suppress development of silver halide. If the PUG is a bleach inhibitor, it can be used to inhibit bleaching of silver during a subsequent processing step. If the PUG is a silver halide complexing agent, it can be used to enhance removal of silver halide from the element during a subsequent processing step or to assist migration of silver halide in the element. If the PUG is an auxiliary developing agent, it can be used to assist development of silver halide. If the PUG is a spectral sensitizing agent, it can be used to render silver halide differentially sensitive to exposure to electromagnetic radiation which occurs contemporaneous with or subsequent to release of the PUG. Still other ways in which the released PUG, can be employed in photographic elements and processes will be apparent to those skilled in the art.

Depending upon the nature of the particular PUG, the compounds of the invention can be incorporated in a photographic element for different purposes and in different locations.

When the PUG released from a compound of the invention is a development inhibitor, it can be employed in a photographic element like couplers which release development inhibitors have been used in the photographic art. The compounds of this invention which release a development inhibitor can be contained in, or in reactive association with, one or more of the silver halide emulsion units in a color photographic element. If the silver halide emulsion unit is composed of more than one layer, one or more of such layers can contain a compound of this invention. The layers can also contain photographic couplers conventionally used in the art.

Photographic compounds of this invention which release bleach inhibitors or bleach accelerators can be employed in the ways described in the photographic art to inhibit the bleaching of silver or accelerated bleaching in areas of a photographic element. Examples of bleach accelerators are described in U.S. application Ser. No. 707,115 of Hall et al filed Feb. 28, 1985.

Photographic compounds of this invention which release development accelerators can be employed in the ways described in the photographic art to accelerate development through solution physical development effects as described in U.S. Pat. Nos. 3,214,377 and 3,253,924, or by increasing the number of development initiation spots as described in U.S. Pat. Nos. 4,518,682 and 4,390,618.

Photographic compounds of this invention which release a dye or dye precursor can be used in processes where the dye is allowed to diffuse to an integral or separate receiving layer to form a desired image. Alternatively, the dye can be retained in the location where it is released to augment the density of the dye formed from the coupler from which it is released or to modify or correct the hue of that dye or another dye.

Photographic compounds of this invention in which the PUG is a developing agent can be used to release a developing agent which will compete with the color forming developing agent, and thus reduce dye density. Alternatively, they can provide, in an imagewise manner, a developing agent which because of such considerations as activity would not desirably be introduced into the element in a uniform fashion.

One of the more significant advantages of the invention are embodiments which produce colorless or easily removed reaction products. A single compound can thus be employed in many different sites in a multilayer photographic element.

In another embodiment of the invention, a photographic element is provided which comprises a support having thereon at least one red-sensitive silver halide emulsion layer having associated therewith a cyan dye providing material, at least one green-sensitive silver halide emulsion layer having associated therewith a magenta dye-providing material, and at least one blue-sensitive silver halide emulsion layer having associated therewith a yellow dye-providing material, at least one of the emulsion layers also having associated therewith a compound containing a hydrazide moiety attached by a linking group, comprising an acidic group or an active methylene group adjacent to an acidic group, to a heteroatom of a moiety containing a photographic reagent; wherein:

(a) the hydrazide moiety is capable of being oxidized to an azo group by an oxidized developing agent,
(b) the azo group formation causes the release of the photographic reagent, and
(c) the released photographic reagent does not contain the linking group or the nitrogen atoms of the hydrazide moiety. The element can also contain additional layers, such as filter layers, interlayers, overcoat layers, subbing layers and the like.

In another embodiment of the invention, a photographic element as described above is exposed and then developed with a silver halide developing agent, thereby oxidizing the developing agent, the hydrazide moiety then being oxidized in an imagewise manner to an azo group by the oxidized developing agent, whereby the azo group formation causes the release of the photographically useful group which does not contain the linking group or the nitrogen atoms of the hydrazide moiety.

Representative compounds included within the scope of the invention include the following:

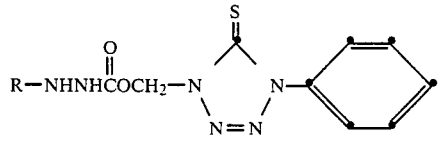

-continued
| Compound | R |
|---|---|
| 1 | 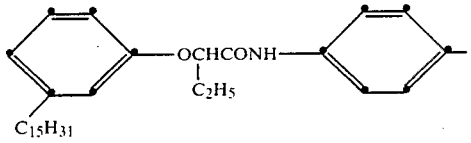 |
| 2 | 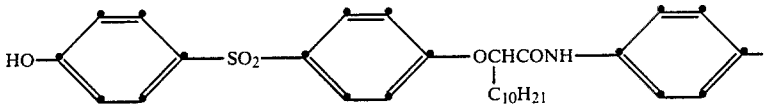 |
| 3 | 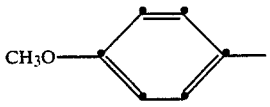 |
| 4 | 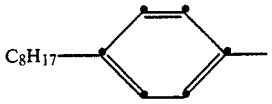 |
| 5 | 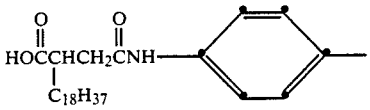 |
| 6 | 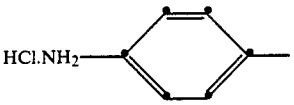 |
| 7 | 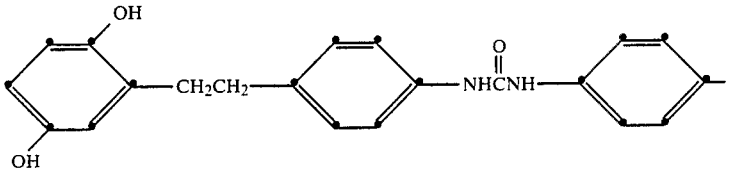 |
| 8 | 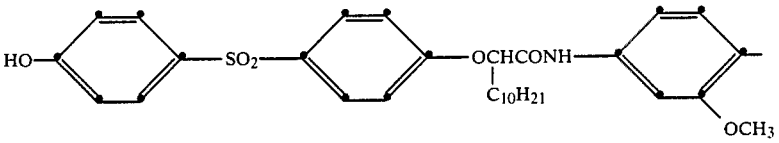 |
| 9 | 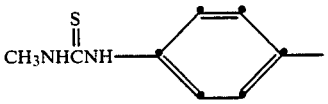 |
| 10 | 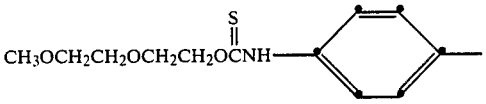 |
| 11 | 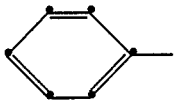 |

-continued
12
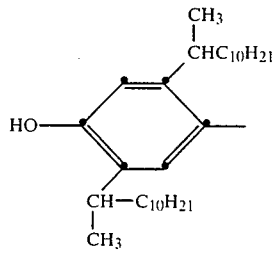
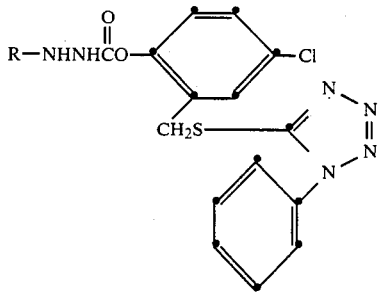
| Compound | R |
|---|---|
| 13 | 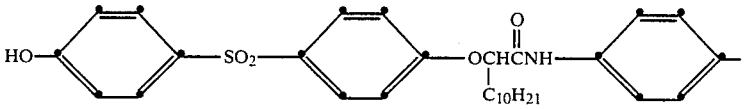 |
| 14 | 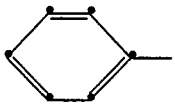 |
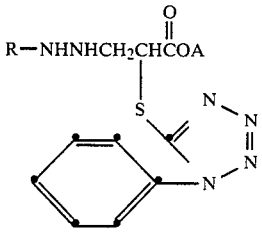
| Compound | R | A |
|---|---|---|
| 15 | 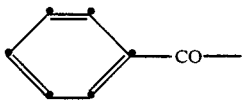 | $-CH_3$ |
| 16 | HCO— | $-CH_3$ |
| 17 | 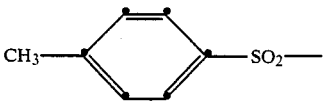 | $-CH_3$ |
| 18 | 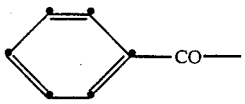 | $-C_{12}H_{25}$ |
| 19 | 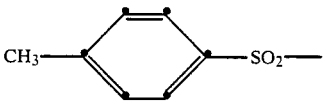 | $-C_{12}H_{25}$ |
| 20 | HCO— | $-C_{12}H_{25}$ |

-continued
| | | |
|---|---|---|
| 21 | 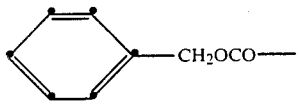 | $-C_{12}H_{25}$ |
| 22 | 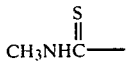 | $-CH_3$ |
| 23 | 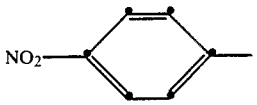 | $-CH_3$ |
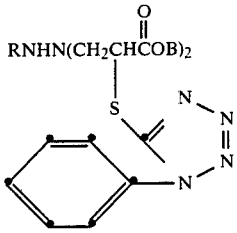
| | R | B |
|---|---|---|
| 24 | 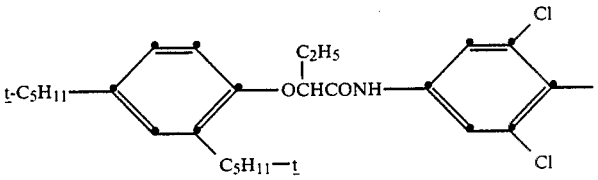 | $-CH_3$ |
| 25 | 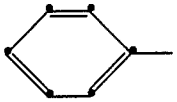 | $-CH_3$ |
26
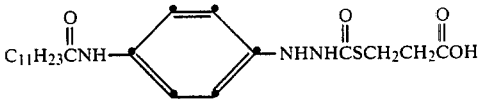
27
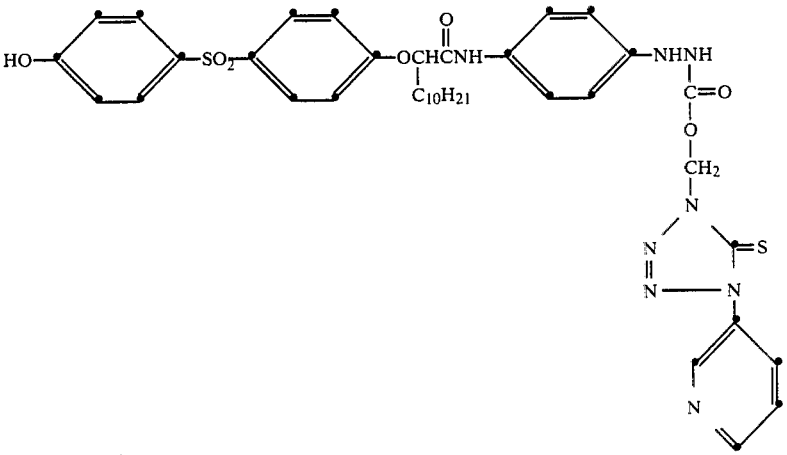

-continued

28

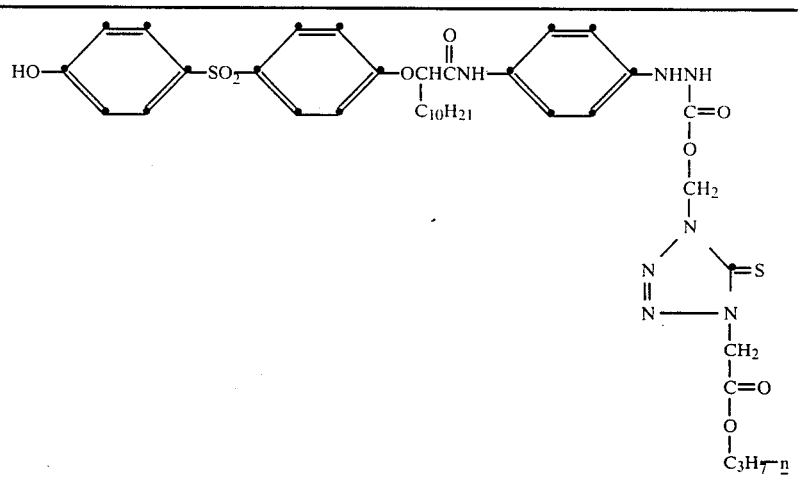

29

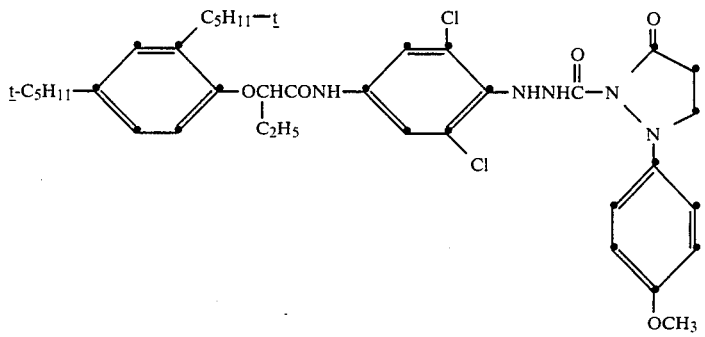

30

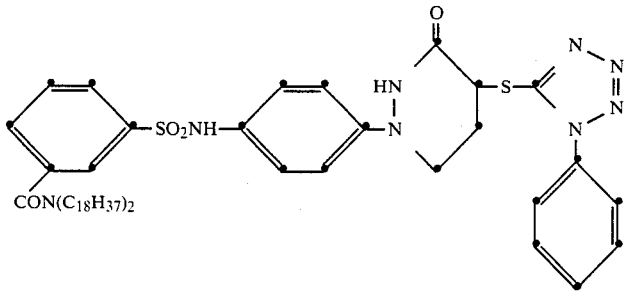

The compounds employed in this invention can be prepared by synthetic steps well known in the art. Generally this involves attaching the PUG-containing group Z to the linking group V, followed by attachment of the hydrazide moiety. If desired, a ballast group can then be attached by reducing a nitro group on R to the corresponding amine, and then treating with a ballasted acid chloride to form an amide bond. Specific preparations are given in the examples hereafter.

As used herein, the term "associated therewith" signifies that the compounds of the invention are in the silver halide emulsion layer or in an adjacent location where, during processing, they will come into reactive association with silver halide development products.

Photographic elements of the invention can be single color elements or multicolor elements. Multicolor elements contain dye image-forming units sensitive to each of the three primary regions of the visible spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer, e.g., as by the use of microvessels as described in Whitmore U.S. Pat. No. 4,362,806 issued Dec. 7, 1982.

In the following discussion of suitable materials for use in the emulsions and elements of this invention, reference will be made to *Research Disclosure,* December 1978, Item 17643, published by Industrial Opportunities Ltd., Homewell Havant, Hampshire, PO9 1EF, U.K., the disclosures of which are incorporated herein by reference. This publication will be identified hereafter by the term "Research Disclosure".

The silver halide emulsions employed in the elements of this invention can be either negative-working or positive-working. Suitable emulsions and their preparation are described in Research Disclosure Sections I and II and the publications cited therein. Suitable vehicles for the emulsion layers and other layers of elements of this invention are described in Research Disclosure Section IX and the publications cited therein.

In addition to the couplers generally described above, the elements of the invention can include additional couplers as described in Research Disclosure Section VII, paragraphs D, E, F and G and the publications cited therein. These couplers can be incorporated in the elements and emulsions as described in Research Disclosure Section VII, paragraph C and the publications cited therein.

The photographic elements of this invention or individual layers thereof, can contain brighteners (see Research Disclosure Section V), antifoggants and stabilizers (See Research Disclosure Section VI), antistain agents and image dye stabilizers (see Research Disclosure Section VII, paragraphs I and J), light absorbing and scattering materials (see Research Disclosure Section VIII), hardeners (see Research Disclosure Section XI), plasticizers and lubricants (See Research Disclosure Section XII), antistatic agents (see Research Disclosure Section XIII), matting agents (see Research Disclosure Section XVI) and development modifiers (see Research Disclosure Section XXI).

The photographic elements can be coated on a variety of supports as described in Research Disclosure Section XVII and the references described therein.

Photographic elements can be exposed to actinic radiation, typically in the visible region of the spectrum, to form a latent image as described in Research Disclosure Section XVIII and then processed to form a visible dye image as described in Research Disclosure Section XIX. Processing to form a visible dye image includes the step of contacting the element with a color developing agent to reduce developable silver halide and oxidize the color developing agent. Oxidized color developing agent in turn reacts with the coupler to yield a dye.

Preferred color developing agents useful in the invention are p-phenylene diamines. Especially preferred are 4-amino-N,N-diethyl-aniline hydrochloride, 4-amino-3-methyl-N,N-diethylaniline hydrochloride, 4-amino-3-methyl-N-ethyl-N-$\beta$-(methanesulfonamido)ethylaniline sulfate hydrate, 4-amino-3-methyl-N-ethyl-N $\beta$-hydroxyethylaniline sulfate, 4-amino-3-$\beta$-(methanesulfonamido)ethyl-N,N-diethyl-aniline hydrochloride and 4-amino-N-ethyl-N-(2-methoxyethyl)-m-toluidine di-p-toluenesulfonic acid.

With negative working silver halide, the processing step described above gives a negative image. To obtain a positive (or reversal) image, this step can be preceded by development with a non-chromogenic developing agent to develop exposed silver halide, but not form dye, and then uniformly fogging the element to render unexposed silver halide developable. Alternatively, a direct positive emulsion can be employed to obtain a positive image.

Development is followed by the conventional steps of bleaching, fixing, or bleach-fixing, to remove silver and silver halide, washing and drying.

The following examples are included for a further understanding of this invention.

EXAMPLE 1

Preparation of Compound 11

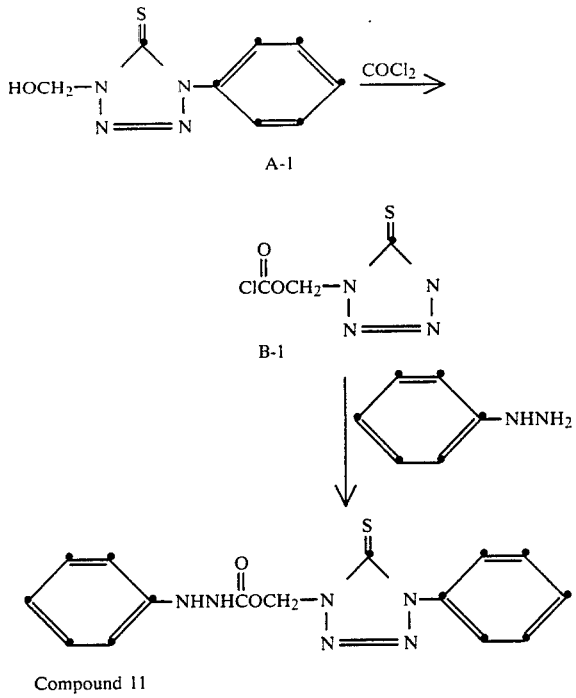

To a stirred solution of solution of 10 g (48 mmol) 1-hydroxymethyl-4-phenyl-2-tetrazoline-5-thione (A-1) in 50 mL tetrahydrofuran was added 10 mL (141 mmol) phosgene and 20 mL N,N-dimethylaniline to produce product (B-1). After 2 hours at room temperature 7 g (65 mmol) 1-phenylhydrazine was added and the mixture stirred overnight. Partitioning in 20% hydrochloric acid/ethyl acetate followed by washing the organic phase with dilute acid and sodium bicarbonate solution, drying over magnesium sulfite, and purifying by silica gel chromatography yielded 2 g compound 11 with the expected nmr spectrum.

EXAMPLE 2

Preparation of Compound 1

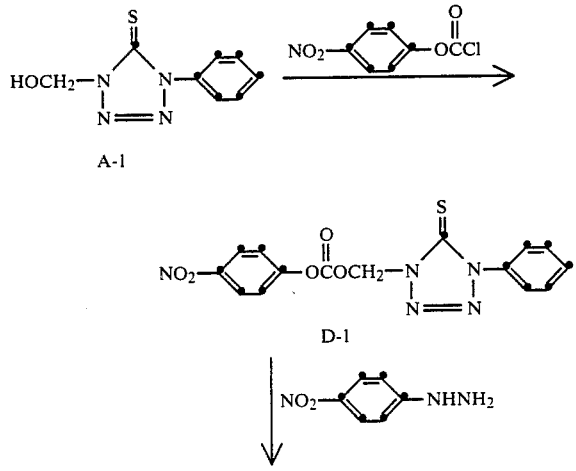

-continued

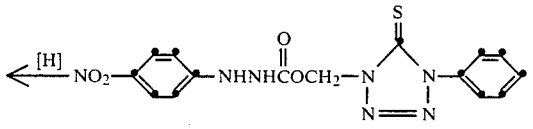

E-1

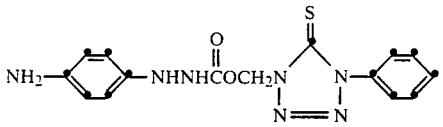

F-1

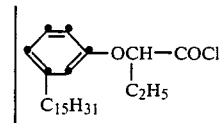

Bal-1

Compound 1

To a solution of 5 g (24 mmol) A-1 and 5 g (25 mmol) p-nitrophenyl chloroformate in 50 mL tetrahydrofuran was added 5 g n,N-dimethylaniline and the mixture was stirred 3 hours at room temperature to produce Compound D-1. Then 4 g (26 mmol) p-nitrophenylhydrazine was added and after 1 hour the mixture was heated at reflux for another hour. The cooled solution was partitioned in 10% hydrochloric acid/ethyl acetate, washed, dried, and purified by chromatography on silica gel to give Compound E-1.

A solution of Compound E-1 in tetrahydrofuran and acetic acid was hydrogenated overnight at 40 psi over a platinum on carbon catalyst. Removal of the catalyst by filtration and of the solvent by evaporation in vacuum gave Compound F-1 as a thick yellow-orange oil. A solution of Compound F-1 in tetrahydrofuran was treated with N,N-dimethylaniline and Bal-1 and stirred overnight. Workup and purification by chromatography and recrystallization from ethanol gave 9 g colorless solid with the nmr spectrum expected for Compound 1.

EXAMPLE 3

Preparation of Compound 2

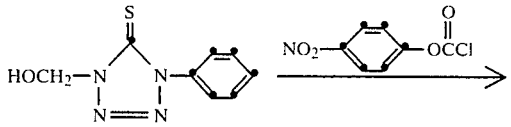

A-1

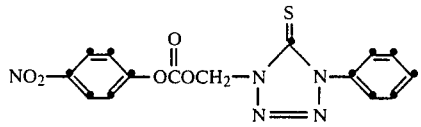

D-1

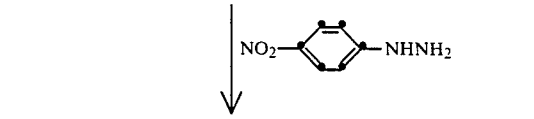

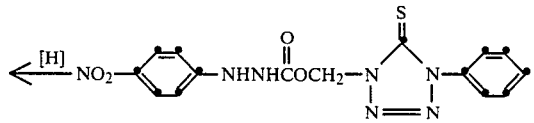

E-1

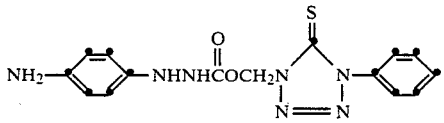

F-1

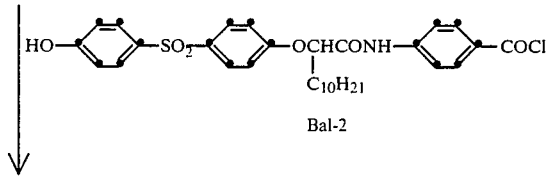

Bal-2

Compound 2

A solution of 4 g (11 mmol) of amine F-1, prepared as in Example 2 above, in tetrahydrofuran was treated with N,N-dimethylaniline and Bal-2, then stirred 2 hours at room temperature. Workup and purification by chromatography yielded 2.4 g colorless solid with the nmr spectrum expected for Compound 2.

EXAMPLE 3

Preparation of Compound 13

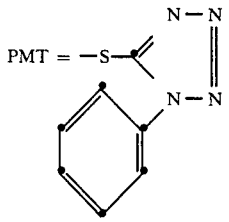

-continued

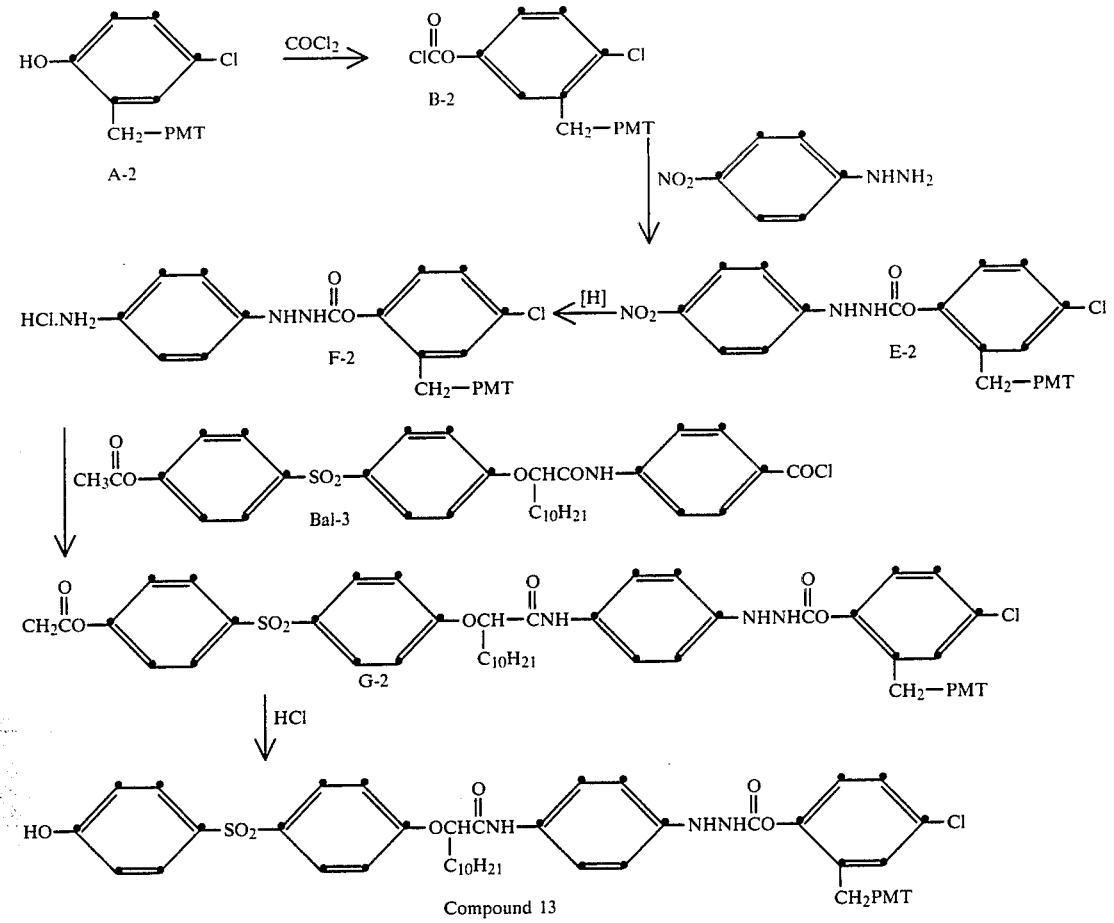

A solution of 7 g (24 mmol) phenolic A-2 in tetrahydrofuran was treated with 6 g (50 mmol) N,N-dimethylaniline and 50 mL 1M phosgene in toluene. After 6 hours stirring at room temperature, 3.7 g (24 mmol) p-nitrophenylhydrazine and 2.9 g (24 mmol) N,N-dimethylaniline were added and stirring was continued overnight. The mixture was then concentrated, dissolved in ethyl acetate, washed with 10% hydrochloric acid solution and saturated sodium chloride solution, dried over magnesium sulfite and concentrated again. Purification by chromatography on silica gel gave 8 g dark red product E-2.

A solution of 7.5 g (15 mmol) nitro compound E-2 in 100 mL tetrahydrofuran was hydrogenated overnight at room temperature and 40 psi over 2 g platinum on carbon catalyst. After removal of catalyst by filtration, the solution was treated with 250 mL ethyl ether saturated with hydrogen chloride to precipitate product F-2 as its hydrogen chloride salt. To a mixture of 6.5 g (13 mmol) F-2 salt and 6.56 g (13 mmol) Bal-3 in 250 mL tetrahydrofuran were added 3.15 g (26 mmol) N,N-dimethylaniline, 1.32 g (13 mmol) triethylamine, and 40 mL dimethylformamide. After stirring overnight at room temperature, workup and chromatography gave product G-2 containing Bal-3.

A solution of 4.0 g (4 mmol) G-2 product in 50 mL methanol was treated with 5 mL concentrated hydrochloric acid then stirred 4 hours at room temperature. Neutralization, workup, and chromatography gave 0.6 g Compound 13 with the expected nmr spectrum.

Compounds 3–10, 12 and 14 can be prepared in a similar manner using the preparative techniques in Examples 1–4 above.

EXAMPLE 5

Preparation of Compounds 18 and 24

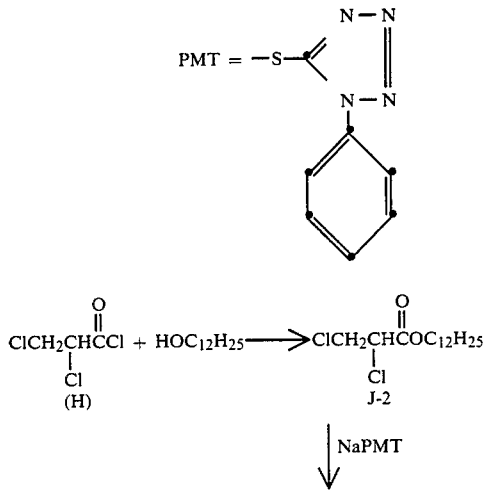

-continued

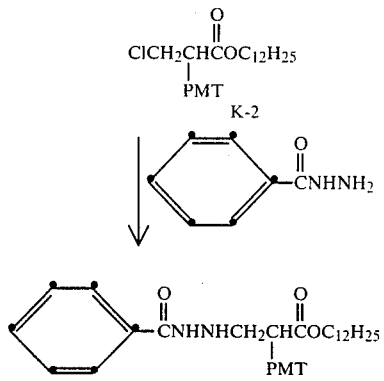

Compound 18

To an ice cold solution of 53.3 g (0.33 mol) 2,3-dichloropropionyl chloride (H) in 100 mL tetrahydrofuran was added dropwise a solution of 61.5 g (0.33 mol) 1-dodecanol and 40 g (0.33 mol) N,N-dimethylaniline in 200 mL tetrahydrofuran. Concentration after stirring overnight at room temperature gave 94.3 g J-2 ester. This ester (0.30 mol) was added to a solution of 70.1 g (0.35 mol) 1-phenyl-1-H-tetrazole-5-thiol sodium salt in 400 mL acetone and the mixture was allowed to reflux 3 days under nitrogen. Partitioning in water/ethyl acetate and workup yielded 103.4 g product K-2.

A solution of 10 g (22 mmol) K-2 ester, 3.0 g (22 mmol) benzhydrazide, and 5.7 g (44 mmol) N,N-diisopropylethylamine in 250 mL tetrahydrofuran was refluxed overnight. Workup provided 8.0 g crude product from which 2.0 g purified Compound 18 as a yellow-orange oil was isolated after silica gel chromatography.

An analogous reaction was used to produce Compound 24 as follows:

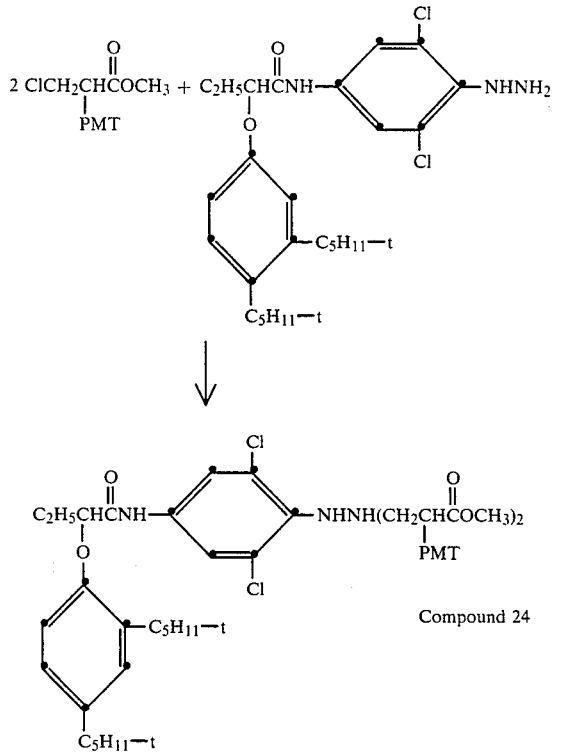

Compound 24

Compounds 15–17, 19–23 and 25–29 can be prepared in a similar manner using the preparative techniques in Example 5 above.

EXAMPLE 6

Improved Color Reversal Interimage Effect

Color reversal processing involves producing a silver negative image in a black and white (MQ) developer, then fogging the residual undeveloped silver in a reversal bath and developing a dye positive image in a color developer. This invention provides a suitable means for releasing a development inhibitor as a function of MQ development. Thus, development of exposed areas of a "causer" layer releases an inhibitor which represses MQ development in a "receiver" layer. The receiver layer then has more than the normal residual undeveloped silver so that subsequent color development gives a boost in dye density in the areas of higher exposure. This additional density in the "receiver" provides color correction for unwanted dye absorptions in the "causer" layer.

Color photographic materials were prepared according to the following schematic layer structure (Coverages are parenthetically given in mg/m2):

(4) Overcoat layer of Gelatin (2690) and Gelatin hardener at 1.75% of total gelatin (3) Causer Layer of Green-sensitive AgBrI (1076), Gelatin (3229), Yellow dye-forming coupler (1399), and Image-modifying compound shown in Table 1

(2) Interlayer of Gelatin (1076)

(1) Receiver Layer of Red-sensitive AgBrI (1076), Gelatin (3122), and Cyan dye-forming coupler (1076)

Film Support of cellulose acetate coated with Gelatin (4887) and Rem Jet antihalation backing The hardener was bis(vinylsulfonylmethyl)ether and the silver bromoiodide (coating weight is that of silver) was a 3.4% iodide ammonium digested emulsion chemically sensitized with sulfur and gold. The following couplers were dispersed in half their weight of dibutyl phthalate and image-modifying compound in twice its weight of diethyl lauramide.

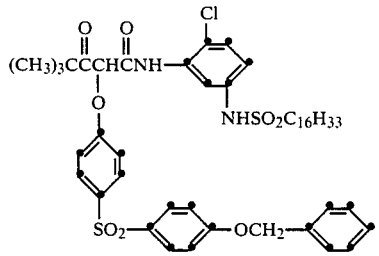

Yellow dye-forming coupler

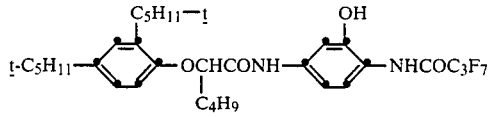

Cyan dye-forming coupler

Film strips were exposed to green light through a stepped density wedge and then to red light through a uniform density filter and processed to give a series of stepped causer layer/flashed receiver layer images. The E-6 processing procedure was employed as described in the British Journal of Photography 1982 Annual, p. 201, but modified by adding potassium hydroxide to the first developer to adjust its pH to 11.0 and by omitting citrazinic acid competing developer from the color developer.

In Table 1, the densitometry of the processed strips is reported for color densities for the "causer" layer and two different flash levels of the "receiver" layer. At a low "causer" layer exposure (step 19), very little development inhibitor is released to the "receiver" layer. But at a 1.2 log E higher exposure (step 11), the "causer" releases much more inhibitor from the inventive compound which leads to depressed "receiver" silver levels during MQ development and enhanced dye density upon color development.

The resultant density boost in the receiver layer is indicated by ΔD. The following results were obtained:

TABLE 1

| Image Modifier | Causer Layer Dmax | "Flashed Receiver" Layer Exp. Level | Density Step 19 | Density Step 11 | ΔD |
|---|---|---|---|---|---|
| None | 2.53 | Low | 2.08 | 2.10 | +.02 |
| (Control) | 2.54 | 0.3 Log E higher | 1.50 | 1.57 | +.07 |
| Compound 2 | 2.76 | Low | 2.62 | 2.78 | +.16 |
| @ 254 mg/m2 | 2.78 | 0.3 Log E higher | 2.00 | 2.25 | +.25 |

It can be seen that the desired density boost for color correction via interlayer interimage effects is achieved in the sample using the compound of the invention.

EXAMPLE 7

Improved Color Negative Interimage Effect

Coatings were made and exposed as in Example 6 but given 3.5 min processing at 38° C. in the following color developer then stopped, bleached, fixed and washed to give step/flash series of negative color images.

| Color Developer Solution | g/L |
|---|---|
| Potassium sulfite | 2.0 |
| 4-Amino-3-methyl-N,N—diethylaniline hydrochloride | 2.45 |
| Potassium carbonate (anhyd.) | 30.0 |
| Potassium bromide | 1.25 |
| Potassium iodide | 0.0006 |
| 1% 5-nitro-1H—indazole in methanol | 0.4 |
| Water to 1L, pH to 10.0 | |

Since inhibitor is released during color development as a function of increasing "causer" layer exposure, the result is a dye density repression in the "receiver" layer instead of the boost seen in Example 6. In the following results, this is measured as a negative gradient (γ) in receiver layer density corresponding to a positive gradient in causer layer density:

TABLE 2

| Image Modifier | Flashed Receiver Layer Rel. Exp. | Dmax | γ | Step Exposed Causer Layer Dmax | γ |
|---|---|---|---|---|---|
| None | 8 | 3.54 | −0.16 | 2.52 | +0.92 |
| (Control) | 4 | 2.92 | −0.14 | | |
| | 2 | 2.50 | −0.10 | | |
| | 1 | 2.07 | −0.06 | | |
| Compound 1 | 8 | 3.49 | −0.66 | 2.49 | +1.05 |

TABLE 2-continued

| Image Modifier | Flashed Receiver Layer Rel. Exp. | Dmax | γ | Step Exposed Causer Layer Dmax | γ |
|---|---|---|---|---|---|
| @118 mg/m² | 4 | 2.92 | −0.66 | | |
| | 2 | 2.59 | −0.64 | | |
| | 1 | 2.07 | −0.46 | | |

It can be seen from these data that remarkably large right-way interlayer image effects can be produced using a compound of this invention.

EXAMPLE 8

Comparison of IRD vs. DIR for Sharpness

Compound 2 of this invention is an inhibitor releasing developer (IRD) which is triggered by a crossoxidation reaction with oxidized color developer (Dox). This example compares this inhibitor release with that triggered by a Dox coupling reaction with a development inhibitor releasing (DIR) coupler C-1.

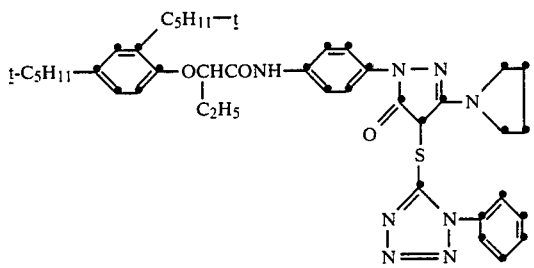

DIR Coupler C-1

To test sharpness and interimage effects, a format was employed in which a green-sensitive "causer" layer provided a magenta image and an underlying red-sensitive "receiver" layer provided a yellow image. Color photographic materials were prepared according to the following schematic layer structure (coating coverages are parenthetically given in mg/m²):

(4) Overcoat layer of Gelatin (2500), and Gelatin hardener, 1.75% of total gelatin (3) Causer Layer of Green-sensitive AgBrI (1600), Gelatin (2400), Magenta dye-forming coupler (915) and Image-modifying compound as shown in Table 3

(2) Interlayer of Antistain agent 2,5-Didodecylhydroquinone (115) and Gelatin (620)

(1) Receiver Layer of Red-sensitive AgBrI (1600), Gelatin (2400), and Yellow dye-forming coupler (1300)

Film Support of Cellulose acetate butyrate coated with antihalation gray silver (324), Gelatin (2452) and Antistain agent (15)

The hardener was bis(vinylsulfonylmethyl) ether and the silver bromoiodide (coating weight is that of silver) was a 6.4% iodide emulsion of 0.5 m average grain size chemically sensitized with sulfur and gold. The yellow dye-forming coupler was dispersed in half its weight of dibutyl phthalate, the magenta coupler in half its weight of tricresyl phosphate, and each image-modifying compound in twice its weight of diethyl lauramide.

The yellow dye-forming coupler was the same as that used in Example 6 and the magenta dye-forming coupler was:

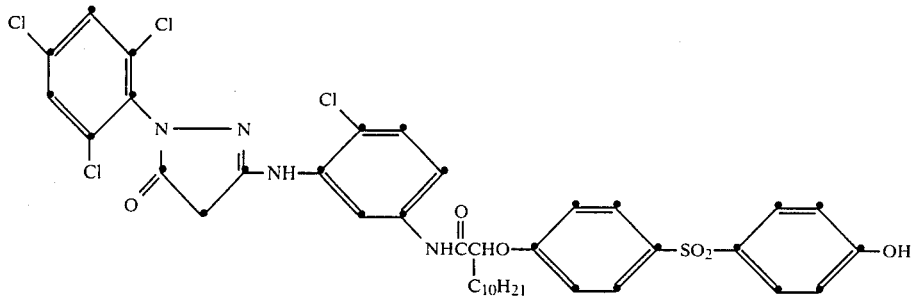

For interimage evaluation requiring image development in both the causer and receiver layers, the samples were exposed through a graduated density test object and Wratten 12 (minus blue) filter. For sharpness, evaluated by calculating CMT acutance values for 16 mm movie film (CMT-16) or 35 mm slide film (CMT-35)*, exposures were made through a Wratten 99 (green) filter. The materials were then processed at 38° C. as follows:

| Color Developer | $2\frac{3}{4}'$ |
|---|---|
| Stop (5% Acetic Acid) | 2' |
| Wash | 2' |
| Bleach ($Fe(CN)_6$) | 2' |
| Wash | 2' |
| Fix | 2' |
| Wash | 2' |

*This technique is discussed in an article entitled: "An Improved Objective Method for Rating Picture Sharpness: CMT Acutance," by R. G. Gendron, Journal of the SMPTE, 82, 1009-12 (Dec., 1973).

| Color developer composition | g/L |
|---|---|
| $K_2SO_3$ | 2.0 |
| 4-Amino-3-methyl-N—ethyl-N—β-hydroxyethylaniline sulfate | 3.35 |
| $K_2CO_3$ | 30.0 |
| KBr | 1.25 |
| KI | 0.0006 |
| $H_2O$ to 1L, Adjusted to pH 10 | |

The gammas of the "causer" layer for a green exposure and for the "causer" and "receiver" layers for a neutral exposure ($\gamma C'$, $\gamma C$, and $\gamma R$, respectively) were read the sensitometric curves. The effects of inhibitor released from each modifier compound were measured by calculating percent gamma repression (% Repr.) in the causer (C) or receiver (R) layers.

$C = 100\ (\gamma_o - \gamma/\gamma_o)$ image of causer layer $R = 100\ (\gamma_o - \gamma/\gamma_o)$ image of receiver layer $Y_o$ = Layer contrast without modifier;

$\gamma$ = layer contrast with modifier.

The following results were obtained:

TABLE 3

| Image Modifier* | Green Exposure Causer Layer γ | Green Exposure Causer Layer % Repr. | Neutral Exposure Causer Layer γ | Neutral Exposure Causer Layer % Repr. | Neutral Exposure Receiver Layer γ | Neutral Exposure Receiver Layer % Repr. | Causer Layer Sharpness CMT-16 | Causer Layer Sharpness CMT-35 |
|---|---|---|---|---|---|---|---|---|
| None (control) | 3.70 | — | 3.86 | — | 1.91 | — | n/a | n/a |
| DIR Cplr. (comparison) (14.7) | 0.88 | 76 | 0.90 | 77 | 1.14 | 40 | 97.6 | 101.1 |
| Cmpd. 2 (21.2) | 0.91 | 75 | 0.95 | 75 | 0.95 | 50 | 97.0 | 101.2 |

*Value in parenthesis is the image modifying compound level as a mole percent of image coupler.

The results show that the IRD compound of the invention can give slightly more gamma repression in the "receiver" layer than the DIR comparison while producing comparable gammas and sharpness values in the "causer" layer.

The invention has been described in detail with particular reference to preferred embodiments thereof, but it will be understood that variations and modifications can be effected within the spirit and scope of the invention.

What is claimed is:

1. A photographic element comprising a support having thereon a silver halide emulsion layer having associated therewith a compound containing a hydrazide moiety attached by a linking group, comprising an acidic group or an active methylene group adjacent to an acidic group, to a heteroatom of a moiety containing a photographically useful group comprising a photographic dye or precursor thereof or a photographic reagent; wherein:

(a) said hydrazide moiety is capable of being oxidized to an azo group by an oxidized developing agent, (b) said azo group formation causes the release of said photographically useful group, and (c) said released photographically useful group does not contain said linking group or the nitrogen atoms of said hydrazide moiety.

2. The element of claim 1 wherein said photographically useful group is released by alkaline hydrolysis, beta-elimination or intramolecular nucleophilic displacement.

3. The element of claim 1 wherein said compound has the formula:

$$RNHNH{-}V{-}Z,\ RY{-}V_n{-}NHNHCH_2\underset{\underset{Z}{|}}{CH}{-}W,$$

-continued

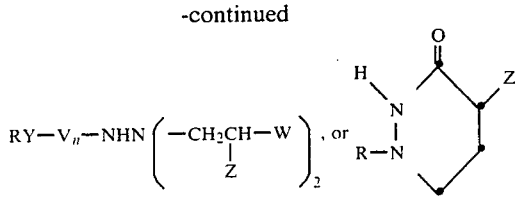

wherein:

R represents a substituted or unsubstituted alkyl group, a substituted or unsubstituted aryl group, or a substituted or unsubstituted heterocyclic group;

V represents an acidic group;

each W independently represents $—NO_2$, —CN, —COOH, $—SO_3H$, or —V—NR;

X represents O, S, or $NR_1$;

Y represents a bond or X;

each Z independently represents $—T_m—PUG$, having a heteroatom at its point of attachment;

T represents a divalent connecting group or a timing group;

PUG represents a photographically useful group;

$R_1$ represents H or R; and n and m each independently represents 0 or 1.

4. The element of claim 3 wherein said Z is attached 1 or 2 atoms removed from the hydrazide moiety.

5. The element of claim 3 wherein said photographic reagent is a development inhibitor, a development accelerator, a bleach inhibitor, a bleach accelerator, a coupler, a developing agent, a silver complexing agent, a fixing agent, a toning agent, a hardening agent, a tanning agent, a fogging agent, an antifogging agent, a spectral sensitizing agent, a chemical sensitizing agent, or a desensitizing agent.

6. The element of claim 5 wherein said photographic reagent is a development inhibitor.

7. The element of claim 3 wherein said acidic group is

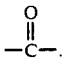

8. A photographic element comprising a support having thereon at least one red-sensitive silver halide emulsion layer having associated therewith a cyan dye-providing material, at least one green-sensitive silver halide emulsion layer having associated therewith a magenta dye-providing material, and at least one blue-sensitive silver halide emulsion layer having associated therewith a yellow dye-providing material, at least one of said emulsion layers also having associated therewith a compound containing a hydrazide moiety attached by a linking group, comprising an acidic group or an active methylene group adjacent to an acidic group, to a heteroatom of a moiety containing a photographic reagent; wherein:

(a) said hydrazide moiety is capable of being oxidized to an azo group by an oxidized developing agent, (b) said azo group formation causes the release of said photographic reagent, and (c) said released photographic reagent does not contain said linking group or the nitrogen atoms of said hydrazide moiety.

9. The element of claim 8 wherein said compound has the formula:

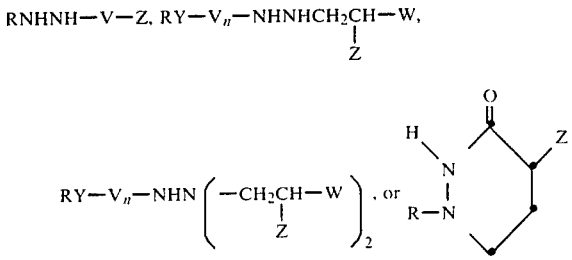

wherein:

R represents a substituted or unsubstituted alkyl group, a substituted or unsubstituted aryl group, or a substituted or unsubstituted heterocyclic group;

V represents an acidic group;

each W independently represents $—NO_2$, —CN, —COOH, $—SO_3H$, or —V—YR;

X represents O, S, or $NR_1$;

Y represents a bond or X;

each Z independently represents $—T_m—PUG$, having a heteroatom at its point of attachment;

T represents a divalent connecting group or a timing group;

PUG represents a photographically useful group;

$R_1$ represents H or R; and n and m each independently represents 0 or 1.

10. The element of claim 9 wherein said Z is attached 1 or 2 atoms removed from the hydrazide moiety.

11. The element of claim 9 wherein said photographic reagent is a development inhibitor, a development accelerator, a bleach inhibitor, a bleach accelerator, a coupler, a developing agent, a silver complexing agent, a fixing agent, a toning agent, a hardening agent, a tanning agent, a fogging agent, an antifogging agent, a spectral sensitizing agent, a chemical sensitizing agent, or a desensitizing agent.

12. The element of claim 11 wherein said photographic reagent is a development inhibitor.

13. The element of claim 9 wherein said acidic group is

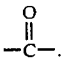

14. A process comprising:

(a) exposing a photographic element comprising a support having thereon a silver halide emulsion layer having associated therewith a compound containing a hydrazide moiety attached by a linking group, comprising an acidic group or an active methylene group adjacent to an acidic group, to a heteroatom of a moiety containing a photographically useful group comprising a photographic dye or precursor thereof or a photographic reagent;

(b) developing said exposed element with a silver halide developing agent, thereby oxidizing said developing agent; and (c) said hydrazide moiety then being oxidized in an imagewise manner to an azo group by said oxidized developing agent;

whereby said azo group formation causes the release of said photographically useful group which does not contain said linking group or the nitrogen atoms of said hydrazide moiety.

15. The process of claim 14 wherein said photographically useful group is released by alkaline hydrolysis, beta-elimination or intramolecular nucleophilic displacement.

16. The process of claim 14 wherein said compound has the formula:

$$RNHNH-V-Z,\ RY-V_n-NHNHCH_2\underset{\underset{Z}{|}}{CH}-W.$$

$$RY-V_n-NHN\left(-CH_2\underset{\underset{Z}{|}}{CH}-W\right)_2,\ \text{or}$$

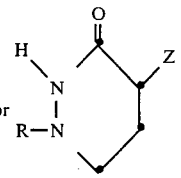

wherein:

R represents a substituted or unsubstituted alkyl group, a substituted or unsubstituted aryl group, or a substituted or unsubstituted heterocyclic group;

V represents an acidic group;

each W independently represents $-NO_2$, $-CN$, $-COOH$, $-SO_3H$, or $-V-YR$;

X represents O, S, or $NR_1$;

Y represents a bond or X;

each Z independently represents $-T_m-PUG$, having a heteroatom at its point of attachment;

T represents a divalent connecting group or a timing group;

PUG represents a photographically useful group;

$R_1$ represents H or R; and n and m each independently represents 0 or 1.

17. The process of claim 16 wherein said Z is attached 1 or 2 atoms removed from the hydrazide moiety.

18. The process of claim 16 wherein said photographic reagent is a development inhibitor, a development accelerator, a bleach inhibitor, a bleach accelerator, a coupler, a developing agent, a silver complexing agent, a fixing agent, a toning agent, a hardening agent, a tanning agent, a fogging agent, an antifogging agent, a spectral sensitizing agent, a chemical sensitizing agent, or a desensitizing agent.

19. The process of claim 18 wherein said photographic reagent is a development inhibitor.

20. The process of claim 16 wherein said acidic group is $$-\overset{\overset{O}{\|}}{C}-.$$

* * * * *